US006001550A

United States Patent [19]

Yacobucci et al.

[11] Patent Number: 6,001,550

[45] Date of Patent: Dec. 14, 1999

[54] PHOTOGRAPHIC ELEMENT HAVING A ANNEALABLE TRANSPARENT MAGNETIC RECORDING LAYER

[75] Inventors: Paul D. Yacobucci; Robert O. James; Catherine A. Falkner; George Musshafen, all of Rochester, N.Y.

[73] Assignee: Eastman Kodak Company, Rochester, N.Y.

[21] Appl. No.: 09/157,456

[22] Filed: Sep. 21, 1998

[51] Int. Cl.[6] ..... G03C 3/02

[52] U.S. Cl. ..... 430/533; 430/140; 430/523

[58] Field of Search ..... 430/140, 533, 430/523

[56] References Cited

U.S. PATENT DOCUMENTS

| | | | |
|---|---|---|---|
| 3,782,947 | 1/1974 | Krall | 430/140 |
| 4,279,945 | 7/1981 | Audran et al. | 430/140 |
| 5,073,534 | 12/1991 | Harrison et al. | 503/227 |
| 5,147,768 | 9/1992 | Sakakibara | 430/140 |
| 5,217,804 | 6/1993 | James et al. | 428/329 |
| 5,229,259 | 7/1993 | Yokota | 430/140 |

*Primary Examiner*—Janet Baxter
*Assistant Examiner*—Amanda C. Walke
*Attorney, Agent, or Firm*—Sarah Meeks Roberts

[57] ABSTRACT

This invention relates to a silver halide photographic element comprising a support having a frontside and a backside;

a light-sensitive silver halide emulsion layer superposed on the frontside of the support; and a transparent magnetic recording layer superposed on the backside of the support, said magnetic recording layer comprising magnetized particles, a dispersing agent and an aromatic polyester binder having a Tg of greater than 150° C.

17 Claims, No Drawings

PHOTOGRAPHIC ELEMENT HAVING A ANNEALABLE TRANSPARENT MAGNETIC RECORDING LAYER

FIELD OF THE INVENTION

This invention relates to a photographic element and more particularly to photographic element having a light-sensitive silver halide layer and a transparent magnetic recording layer.

BACKGROUND OF THE INVENTION

It is known from various U.S. patents, including: U.S. Pat. Nos. 3,782,947; 4,279,945; 5,217,804; 5,147,768; 5,229,259, and others; to include in a light-sensitive silver halide photographic element a transparent magnetic recording layer. Such elements are advantageous because they can be employed to record images by the customary photographic process while at the same time information can be recorded into and read from the magnetic recording layer by the techniques similar to those employed in the magnetic recording art.

The magnetic recording layers used in the magnetic recording industry, however, are usually opaque, not only because of the nature of the magnetic particles, but also because of the other additives required in the recording layer. For obvious reasons such opaque layers are not suitable for use with photographic elements. Further, the recording and reading requirements of the magnetic signal from a transparent magnetic layer present on a photographic element are more stringent those of a conventional magnetic recording because of the loading of the magnetic particles in the transparent magnetic layer and the nature of the photographic element. The magnetic recording layer of the photographic element must be capable of accurately recording the information applied thereto and reading out the information on demand. This is particularly difficult because the loading of the magnetic particles in the transparent layer must not interfere with the quality of the photographic elements.

The photographic element and particularly the transparent magnetic recording layer provided thereon must also be capable of repeated use in both the recording and reading mode and, therefore, must have improved running, durability, and head cleaning. For example, during the residence of the film in a camera, entries may be made to the magnetic recording layer for every exposure, and an indeterminate number of read operations are conducted depending on the particular application in which the film is used. This also is true in the processing of the film and in subsequent use of the processed film for additional copies, enlargements and the like. Also, because of the curl of the element, primarily due to the photographic layers and core set, the film must be held tightly against the magnetic heads by pressures much higher than those in conventional magnetic recording in order to maintain film plane flatness in the recording and reading zone. Finally, it is desirable that a transparent magnetic recording layer superposed on a backside of the support can be annealed at temperatures in excess of 80 deg. C. prior to emulsion coating without degrading physical properties or interfering with the quality of the photographic element.

Therefore, a need exists for a photographic element having a transparent magnetic recording layer exhibiting improved magnetic and photographic performance as well as improved running durability and head cleaning properties. All of these various characteristics must be considered both independently and cumulatively in order to arrive at a commercially viable photographic element.

SUMMARY OF THE INVENTION

This invention provides a silver halide photographic element comprising

- a support having a frontside and a backside;
- a light-sensitive silver halide emulsion layer superposed on the frontside of the support; and
- a transparent magnetic recording layer superposed on the backside of the support, said magnetic recording layer comprising magnetized particles, a dispersing agent and an aromatic polyester binder having a Tg of greater than 150° C. In one embodiment the polyester binder is the reaction product of dibasic aromatic acids and dihydroxy phenols.

The above magnetic layer is a low bit density (transparent) recording layer capable of accurately recording and reading out information on demand. It exhibits improved running durability and head cleaning properties. Additionally, the magnetic layer can be annealed at temperatures in excess of 80° C. during manufacture of the photographic element (prior to emulsion coating) without degrading the physical properties of the photographic element.

DETAILED DESCRIPTION OF THE INVENTION

The transparent magnetic recording layer contains magnetic particles which preferably are acicular or needle like magnetic particles. Whether a photographic element is useful for both photographic and magnetic recording depends on both the size distribution and concentration of the magnetic particles and on the relationship between the granularities of the magnetic and photographic coatings. Generally, the mean size of the magnetic particles that can be tolerated relates directly to the grain of the photographic emulsion. That is, larger size magnetic particles are tolerable in grainy films. A magnetic particle concentration between about 10 and 1000 mg/m$^2$ when uniformly distributed across the desired area of the photographic element will be sufficiently photographically transparent provided that the maximum particle size is less than about 1 micron. Particle concentrations less than about 10 mg/m$^2$ tend to be insufficient for magnetic recording purposes and particle concentrations greater than about 1000 mg/m$^2$ tend to be to dense for photographic purposes. Particularly useful particle concentrations are in the range of 20–70 mg/m$^2$. Concentrations of about 30 mg/m$^2$ have been found to be particularly useful in reversal films and concentrations of about 60 mg/m$^2$ are particularly useful in negative films.

It is preferred that the particles have a surface area greater than 30 m$^2$/gm and preferably greater than 40 m$^2$/gm. The coverage of the magnetic particles in the magnetic recording layer depends upon the thickness of the magnetic recording layer. For optimum performance, the magnetic recording layer should be such that normal wear will not result in signal loss after multiple reading and writing operations. However, the layer must not be so thick as to interfere with the photographic properties of the film. The magnetic particles are preferably present in the magnetic recording layer in an amount of from about 1 to about 10 percent by weight based upon the weight of the binder and most preferably in an amount of 2 to 7 percent in a layer of 1.0 to 1.5 microns dry thickness.

Preferred magnetic particles include ferromagnetic particles which are ferromagnetic iron oxides, such as $\gamma$-$Fe_2O_3$, $Fe_3O_4$ or $\gamma$-$Fe_2O_3$, $Fe_3O_4$ with Co, Zn or other metals in solid solution or surface treated, barium or strontium ferrites; or ferromagnetic chromium dioxide, such as $CrO_2$ or $CrO_2$ with metallic elements, for example Li, Na, Sn, Pb, Fe, Co, Ni, and Zn, or halogen atoms in solid solution. Ferromagnetic metal particles with an oxide coating on the surface to improve dispersibility, as is commonly used in conventional magnetic recording, may also be used in accordance with the invention such as tin oxide, aluminum oxide or silicon dioxide particles. In addition, magnetic oxides with a thicker layer of lower refractive index oxide or other material having a lower optical scattering cross-section as taught in U.S. Pat. Nos. 5,217,804 and 5,252,444 may also be used. Cobalt surface treated iron oxide is the preferred ferromagnetic material for use with this invention.

The aromatic polyester binder used in the magnetic layer is one which has a Tg of greater than 150° C., preferably greater than 170° C., and more preferably greater than 190° C. Suitable polymers will generally have a Tg in the range of about 190° C. to as high as about 300° C. and a molecular weight in the range of about 25,000 to about 250,000.

One suitable non-limiting example of an aromatic polyester binder is polycarbonates, the reaction product of carbonic acid chloride or phosgene and a dihydroxyphenol compound. More preferably, the polyester binder is selected from the group consisting of those polymers formed by the reaction of at least one dibasic aromatic acid and at least one dihydroxyphenol. In one embodiment the dibasic aromatic acid can be illustrated by the following generic structure:

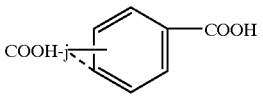

wherein j is an optional linking group positioned meta or para to the carboxyl group of the phenyl ring or j may also represent the atoms necessary to form a 5- or 6-membered fused carboxylic or heterocyclic ring between any two adjacent carbon atoms of the phenyl ring. In one embodiment j is selected from groups such as the following:

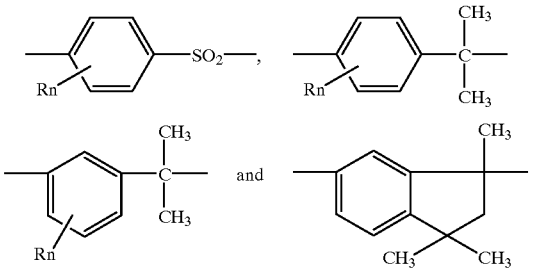

or j is a 5 or 6 membered ring which forms the following dibasic acid structures:

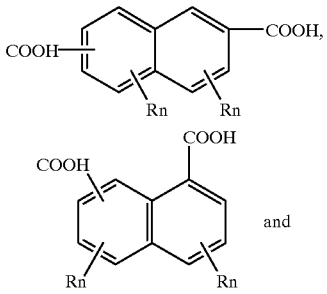

-continued

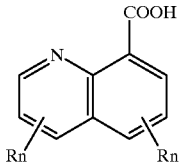

In the above, R can be a hydrogen or halide atom, a substituted or unsubstituted alkyl or alkoxy group of from 1 to about 6 carbon atoms or, a substituted or unsubstituted aryl group of from about 6 to about 10 carbon atoms; and n is an integer from 1 to 4.

Representative examples of dibasic acids that can be used include the following: terephthalic acid, isophthalic acid, 2,5-dimethylterephthalic acid, 2,5-dibromoterephthalic acid, bis(4-carboxyphenel)sulfone, 1,1,3-trimethyl-3-(4-carboxyphenyl)-5-indanecarboxylic acid, 2,6-naphthalenedicarboxylic acid, and 2,2-bis(4-carboxyphenyl) propane. A blend of terephthalic acid and isophthalic acid are the preferred dibasic aromatic acids in accordance with this invention.

The dihydroxyphenols used to react with the above dibasic aromatic acids to form the defined polyesters can be illustrated by the following structure:

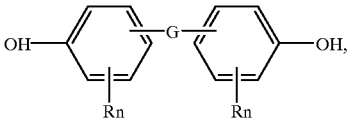

wherein G is a linking group positioned meta or para to each phenolic hydroxyl and can be selected from the following:

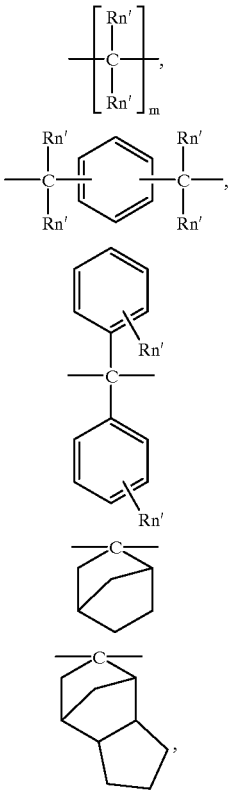

-continued

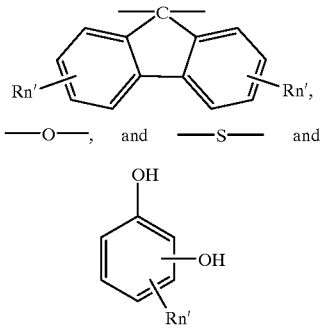

wherein the hydroxyl groups of the above immediate structure are positioned meta or para to each other. R and n' are the same as R and n above and m is an integer ranging from 1 to 6.

Representative specific examples of dihydroxyphenols that can be used include the following: 4,4' (hexafluroisopropylidene) diphenol (bisphenol AF), 4,4'-isopropylidenediphenol (bisphenol A), 4,4'-isopropylidene-2,2',6,6'-tetrachlorobisphenol, 4,4'-isopropylidene-2,2'6,6'-tetrabromobisphenol, 4,4'-(hexahydro-4,7-methanoinden-5-ylidene) bisphenol, 4,4'-(2-norbomylidine) bisphenol, 9,9-bis-(4-hydroxyphenol) fluorene, bis(4-hydroxyphenyl) diphenol methane, 1,4-bis(p-hydroxycumyl)benzene, 1,3-bis(p-hydroxycumyl)benzene, 4,4'-oxybisphenol, hydroxyquinone, and resorcinol. 4,4' (hexafluroisopropylidene) diphenol is the preferred dihydroxyphenol in accordance with this invention.

Examples of suitable polyesters that can be prepared using the above dibasic aromatic acids and dihydroxyphenols usable herein include those having the following recurring units. Polyester 5 is particularly useful.

Polyester 1

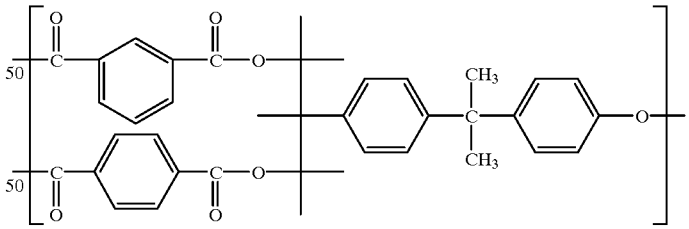

Tg = 170

(a copolyester derived from terephthalic acid, isophthalic acid and bisphenol-A), Polyester 2

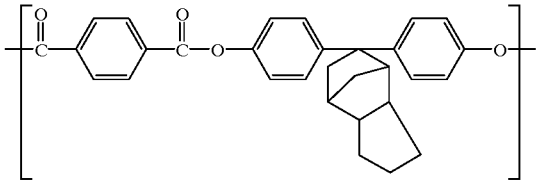

Tg = 299

(a polyester derived from terephthalic acid and 4,4′-(hexahydro-4,7-methanoinden-5-ylidene)bisphenol), Polyester 3

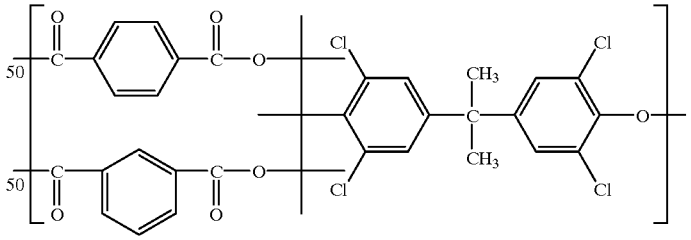

Tg = 231

(a copolyester derived from terephthalic acid, isophthalic acid, and 4,4′-isopropylidene-2,2′, 6,6′-tetrachlorobisphenol), Polyester 4

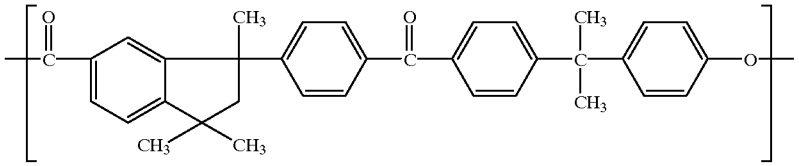

Tg = 247

(a polyester derived from 1,1,3-trimethyl-3-(4-carboxyphenyl)-5-indanecarboxylic acid and bisphenol-A), Polyester 5

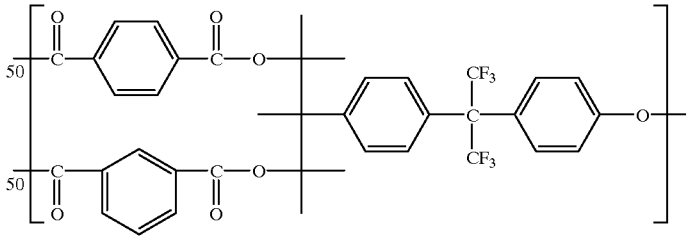

Tg = 223

(a polyester derived from terephthalic acid, isophthalic acid and 4,4′(hexafluroisopropylidene diphenol).

The aromatic polyesters used herein can be prepared using any suitable or conventional procedure. The procedure used herein followed that outlined by P. W. Morgan in *Condensation Polymers: By Interfacial and Solution Methods,* Interscience, New York City, N.Y. (1965).

In one embodiment the transparent magnetic recording layer is prepared by initially forming a high solids content magnetic concentrate by mixing the magnetic particles in a suitable grind solvent together with a polymeric hyperdispersant and milling the mixture in a device such as a ball mill, a roll mill, a high speed impeller mill, media mill, an attritor or a sand mill. Milling proceeds for a sufficient time to ensure that substantially no agglomerates of the magnetic particles remain.

In a separate container, the binder polymer is dissolved in a suitable solvent. To this solution is added the magnetic concentrate and stirring is continued. If abrasive particles will be utilized a dispersion of the abrasive particles is prepared by milling to break up agglomerates of the abrasive particles and this is added to the mixer containing the binder solution and concentrate to form the coating composition.

Coating composition is used herein as a term for the magnetic layer prior to coating on a support. This composition may be coated onto a suitable support in its present form or additional and optional ingredients such as, coating aids, lubricants and the like may be added before the coating operation. The coating composition is applied to a suitable support, which may contain additional layers for promoting adhesion, by any suitable coating device including slot die hoppers, slide hoppers, gravure coaters, reverse roll coaters and the like. The magnetic layer is superposed on the opposite side of the support from the photographic layer.

Dispersing agents, sometimes referred to as wetting agents or a surface active agent, can be present in the dispersion to facilitate dispersion of the particles and/or wetting of the particles with the dispersing medium. This helps further minimize agglomeration of the particles. Examples of useful classes of dispersing agents include fatty acid amines and commercially available wetting agents such Witco Emcol CC59 which is a quarternary amine available from Witco Corp. (Greenwick, Conn.); Rhodafac PE 510, Rhodafac RE610, Rhodafac RE960, and Rhodafac LO529 which are phosphoric acid esters available from Rhone-Poulenc, and Solsperse 24000 which is a polyester-polyamine sold by Zeneca, Inc. (Wilmington, Del.). Solsperse 24000 is the preferred dispersing agent in accordance with this invention as described in U.S. Pat. No. 5,395,743.

As noted above, other constituents of the coating composition may include grind solvents, coating aids, and solvents for the binder. Grind solvents are preferably those having a high boiling point, generally greater than 60° C. One general class of particularly useful grind solvents are the organic acid esters such as phthalic acid esters. Preferred esters are dialkylesters of phthalic acid, the alkyl portion of which can contain from 1 to about 12, preferably 4 to 8, carbon atoms. Exemplary useful esters include dimethyl phthalate, diethyl phthalate, dioctyl phthalate, dipropyl phthalate, and dibutyl phthalate as disclosed in U.S. Pat. No. 4,990,276.

Suitable coating aids include, but are not limited to, nonionic fluorinated alkyl esters such as, FC-430, FC-431 sold by Minnesota Mining and Manufacturing Co. (St. Paul, Minn.), polysiloxanes such as, Dow Corning DC 1248, DC 200, DC 510, DC 190 sold by Dow Corning Corp. (Midland, Mich.) and BYK 310, BYK 320, and BYK 322 sold by BYK Chemie and SF 1079, SF 1023, SF 1054 and SF 1080 sold by General Electric Co. (Waterford, N.Y.).

Additional organic solvents are normally used for the preparation of the final coating dispersion. Examples of suitable solvents are ketones such as methyl ethyl ketone and cyclohexanone; esters, such as methyl acetate, ethyl acetate, and butyl acetate; ethers, such as tetrahydrofuran; aromatic solvents, such as toluene; and chlorinated hydrocarbons, such as chloroform, dichloromethane, and carbon tetrachloride. Mixtures of chlorinated hydrocarbons, and ketones are preferred.

The abrasive particles, when utilized in the magnetic layer, are present in an amount of from about 1% to about 20% by weight based on the weight of the binder present. Most preferably, the abrasive particles are present in an amount of about 1 to 7 percent based on the weight of the binder. Examples of suitable abrasive particles include non-magnetic inorganic powders with a Mohs scale hardness of not less than 6. The preferred particle size is from about 0.1 to about 0.3 microns, with 0.2 microns being most preferred. Specific examples include but are not limited to metal oxides such as alpha-alumina, chromium oxide ($Cr_2O_3$), alpha-$Fe_2O_3$, silicon dioxide, alumino-silicate and titanium carbide; nitrides such as, silicon nitride, titanium nitride and diamond in fine powder. Alpha alumina and silicon dioxide are the preferred abrasives in accordance with this invention. The abrasive particles may also be coated in a separate layer.

Any suitable support may be employed in the practice of this invention, such as, cellulose derivatives including cellulose diacetate, cellulose triacetate, cellulose propionate, cellulose butyrate, cellulose acetate propionate and the like; polyamides, polycarbonates, polyesters, particularly polyethylene, terephthalate, poly-1,4.-cyclohexanedimethylene terephthalate, polyethylene 1,2-diphenoxyethane-4,4'-dicarboxylate, polybutylene terephthalate and polyethylene naphthalate; polystyrene, polypropylene, polyethylene, polymethyl-pentene, polysulfone, polyethersulfone, polyarylates, polyether imides and the like. Particularly preferred supports are polyethylene terephthalate, polyethylene naphthalate and the cellulose esters, particularly cellulose triacetate.

Thickness of those supports used in the present invention is generally from 50 $\mu$m to 180 $\mu$m, preferably, 85 to 125 microns. In addition, various dyes may be formulated into the support or the magnetic layer to give neutral density.

In one suitable embodiment the photographic elements may have an annealed polyethylene naphthalate film base such as described in Hatsumei Kyoukai Koukai Gihou No. 94-6023, published Mar. 15, 1994 (Patent Office of Japan and Library of Congress of Japan) and may be utilized in a small format system, such as described in *Research Disclosure,* June 1994, Item 36230 published by Kenneth Mason Publications, Ltd., Dudley Annex, 12a North Street, Emsworth, Hampshire PO10 7DQ, ENGLAND, and such as the Advanced Photo System, particularly the Kodak ADVANTIX films or cameras.

Depending upon the nature of the support, suitable transparent tie or undercoat layers may be desired. Particularly with regard to polyester supports, primers are used in order to promote adhesion. Any suitable primers in accordance with those described in the following U.S. patents may be employed: U.S. Pat. Nos. 2,627,088; 3,501,301; 4,689,359; 4,363,872; and 4,091,952. Each of these are incorporated herein by reference in their entirety.

The magnetic layer can also be overcoated with conventional layers including antistats, protective overcoats, lubricants and the like. The conducting layers, such as antistatic layers and/or anti-halation layers such as described in Research Disclosure, Vol. 176, December 1978, Item 17643 prevent undesirable static discharges during manufacture, exposure and processing of the photographic element. Antistatic layers conventionally used in color films have been found to be satisfactory for use herewith. Any of the antistatic agents set forth in U.S. Pat. No. 5,147,768, which is incorporated herein by reference may be employed. Preferred antistats include metal oxides, for example, tin oxides, zinc antimonates, indium antimonates, antimony doped tin oxide, vanadium pentoxide and silver doped vanadium pentoxide.

Protective or lubricating layers can include, but are not limited to silicone oil, silicones having polar groups, fatty acid-modified silicones, fluorine-containing silicones, fluorine-containing alcohols, fluorine-containing esters, polyolefins, polyglycols alkyl phosphates and alkali metal salts thereof, alkyl sulfates and alkali metal salts thereof, polyphenyl ethers, fluorine-containing alkyl sulfates and alkali metal salts thereof, monobasic fatty acids having 10 to 24 carbon atoms (which may contain unsaturated bonds or may be branched) and metal salts thereof (such as Li, Na, K and Cu), monovalent, divalent, trivalent, tetravalent, pentavalent and hexavalent alcohols having 12 to 22 carbon atoms (which may contain unsaturated bonds or may be branched), alkoxy alcohols having 12 to 22 carbon atoms, mono-, di and tri-esters of monobasic fatty acids having 10 to 24 carbon atoms (which may contain unsaturated bonds or may be branched) and one of monovalent, divalent, trivalent, tetravalent, pentavalent and hexavalent alcohols having 2 to 12 carbon atoms (which may contain unsaturated bonds or may be branched), fatty acid esters of monoalkyl ethers of alkylene oxide polymers, fatty acid amides having 8 to 22 carbon atoms and aliphatic amines having 8 to 22 carbon atoms.

Specific examples of these compounds (i.e., alcohols, acids or esters) include lauric acid, myristic acid, palmitic acid, stearic acid, behenic acid, butyl stearate, oleic acid, linolic acid, linolenic acid, elaidic acid, octyl stearate, amyl stearate, isooctyl stearate, butyl myristate, octyl myristate, butoxyethyl stearate, anhydrosorbitan monostearate, anhydrosorbitan distearate, anhydrosorbitan tristearate, pentaerythrityl tetrastearate, oleyl alcohol and lauryl alcohol. Carnauba wax is preferred.

In one embodiment of the invention, reinforcing filler particles may be included in the magnetic recording layer and/or the abrasive layer. The reinforcing filler particles have a median diameter of from 0.04 to 0.15 $\mu$m, preferably 0.04 to 0.1 $\mu$m and most preferably 0.04 to 0.08 $\mu$M. The filler particles have a Mohs hardness greater than 6 and are present in an amount of from 20 to 300 percent by weight and preferably from 50 to 120 percent and most preferably from 65 to 85 percent based on the weight of the binder, Examples of the reinforcing filler particles include non-magnetic inorganic powders with a Mohs scale hardness of at least 6. Specific examples are metal oxides such as μ-aluminum oxide as described in U.S. Pat. Nos. 5,436,120 and 5,432,050, chromium oxide (Cr2 O3), iron oxide (alpha-Fe2 O3), tin oxide, doped tin oxide, such as antimony or indium doped tin oxide, silicon dioxide, alumino-silicate and titanium dioxide; carbides such as silicon carbide and titanium carbide; and diamond in fine powder. Gamma aluminum oxide and silicon dioxide are preferred. The important feature is that the filler particles have the particle size and are used in the amounts expressed above.

As noted, photographic elements in accordance with this invention comprise at least one photosensitive layer. Such photosensitive layers can be image-forming layers containing photographic silver halides such as silver chloride, silver bromide, silver bromoiodide, silver chlorobromide and the like. Both negative and reversal silver halide elements are contemplated. For reversal films, the emulsion layers as taught in U.S. Pat. No. 5,236,817, especially Examples 16 and 21, are particularly suitable. The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Any of the known silver halide emulsion layers, such as those described in Research Disclosure, Vol. 176, December 1978 Item 17643 and Research Disclosure Vol. 225, January 1983 Item 22534, the disclosures of which are incorporated by reference in their entirety, are useful in preparing photographic elements in accordance with this invention.

Generally, the photographic element is prepared by coating the support film on the side opposite the magnetic recording layer with one or more layers comprising a dispersion of silver halide crystals in an aqueous solution of gelatin and optionally one or more subbing layers, such as, for example, gelatin, etc. The coating process can be carried out on a continuously operating machine wherein a single layer or a plurality of layers are applied to the support. For multicolor elements, layers can be coated simultaneously on the composite support film as described in U.S. Pat. No. 2,761,791 and U.S. Pat. No. 3,508,947. Additional useful coating and drying procedures are described in Research Disclosure, Vol. 176, December 1978, Item 17643. Suitable photosensitive image forming layers are those which provide color or black and white images.

In one embodiment a polyester film support used in the manufacture of the photographic element is coated with an adhesion promoting polymer followed by additional layers coated on either or both sides of the support including, but not limited to; a gelatin-containing layer, an antistat layer, an annealable transparent magnetic recording layer, and an annealable wax layer. The complete package, when annealed at or above 90° C. exhibits reduction in degradation and reduced blocking of the transparent magnetic recording layer.

In the following Table, reference will be made to (1) *Research Disclosure,* December 1978, Item 17643, (2) *Research Disclosure,* December 1989, Item 308119, (3) *Research Disclosure,* September 1994, Item 36544, and (4) *Research Disclosure,* September 1996, Item 38957, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing, processing and manipulating the elements, and the images contained therein. Photographic elements and methods of processing such elements particularly suitable for use with this invention are described in *Research Disclosure,* February 1995, Item 37038, published by Kenneth Mason Publications, Ltd., Dudley Annex, 12a North Street, Emsworth, Hampshire PO10 7DQ, ENGLAND, the disclosure of which is incorporated herein by reference.

| Reference | Section | Subject Matter |
|---|---|---|
| 1 | I, II | Grain composition, |
| 2 | I, II, IX, X, XI, XII, XIV, XV | morphology and preparation. Emulsion preparation including |
| 3 & 4 | I, II, III, IX A & B | hardeners, coating aids, addenda, etc. |
| 1 | III, IV | Chemical sensitization and |
| 2 | III, IV | spectral sensitization/ |
| 3 & 4 | IV, V | desensitization |
| 1 | V | UV dyes, optical |
| 2 | V | brighteners, luminescent |
| 3 & 4 | VI | dyes |
| 1 | VI | Antifoggants and |
| 2 | VI | stabilizers |
| 3 & 4 | VII | |
| 1 | VIII | Absorbing and scattering |
| 2 | VIII, XIII, XVI | materials; Antistatic layers; matting agents |
| 3 & 4 | VIII, IX C & D | |
| 1 | VII | Image-couplers and image- |
| 2 | VII | modifying couplers; Wash- |
| 3 & 4 | X | out couplers; Dye stabilizers and hue modifiers |
| 1 | XVII | Supports |
| 2 | XVII | |
| 3 & 4 | XV | |
| 3 & 4 | XI | Specific layer arrangements |
| 3 & 4 | XII, XIII | Negative working emulsions; Direct positive emulsions |
| 2 | XVIII | Exposure |
| 3 & 4 | XVI | |
| 1 | XIX, XX | Chemical processing; |
| 2 | XIX, XX, XXII | Developing agents |
| 3 & 4 | XVIII, XIX, XX | |
| 3 & 4 | XIV | Scanning and digital processing procedures |

The photographic elements can be incorporated into exposure structures intended for repeated use or exposure structures intended for limited use, variously referred to as single use cameras, lens with film, or photosensitive material package units.

The photographic elements can be exposed with various forms of energy which encompass the ultraviolet, visible, and infrared regions of the electromagnetic spectrum as well as the electron beam, beta radiation, gamma radiation, X-ray, alpha particle, neutron radiation, and other forms of corpuscular and wavelike radiant energy in either noncoherent (random phase) forms or coherent (in phase) forms, as produced by lasers. When the photographic elements are intended to be exposed by X-rays, they can include features found in conventional radiographic elements.

The photographic elements are preferably exposed to actinic radiation, typically in the visible region of the spectrum, to form a latent image, and then processed to form a visible dye image. Development is typically followed by the conventional steps of bleaching, fixing, or bleach-fixing, to remove silver or silver halide, washing, and drying.

The invention will be further illustrated by, but not limited to, the following examples in which parts and percentages are given by weight unless otherwise specified.

EXAMPLE 1

TABLE 1

| Dispersion Ingredients | Weight Percent | g |
|---|---|---|
| Magnetic particle Toda CSF-4085V2* | 19.5 | 40.0 |
| Dispersing Agent Zeneca Solsperse 24000** | 2.44 | 5.0 |
| Dispersing Medium dibutyl phthalate | 78.05 | 160.0 |

*The magnetic particles utilized were cobalt surface treated gamma $Fe_2O_3$ obtained from Toda Kogyo Corp., Hiroshima, Japan.
**Zeneca, Inc.

The above ingredients were blended in a temperature controlled jacketed vessel and mixed together with a high speed disperser and the appropriately sized Cowles type dispersion blade at a tangential blade speed of 4000 feet per minute for 120 minutes. The blade diameter is selected so it is about ½ the mixing vessel diameter. The blade was positioned in the mixing vessel so that it was about 1 blade diameter from the bottom of the vessel. The water jacket temperature was held at 60° C. Once a consistent dispersion was achieved free of excessively large particle aggregates, the dispersion was processed in ajar roller. The grinding media was 1.3 millimeter Chromanite steel spheres. The grinding chamber volume was 1 quart and 900 grams of grinding media was added to the grinding zone. The roller speed was maintained at a speed of 100 rpm. Dispersions prepared in this fashion exhibit excellent colloidal stability on aging and do not contribute to the image grain of films coated with low levels of this product.

EXAMPLE 2

TABLE 2

| Dispersion Ingredients | Weight Percent | g |
|---|---|---|
| Magnetic particle Toda CSF-4085V2 | 35.8 | 360 |
| Dispersing Agent Zeneca Solsperse 24000 | 4.5 | 45 |
| Dispersing Medium dibutyl phthalate | 59.7 | 600 |

The above ingredients were milled in a 250 cc small media mill with continuous recirculation of the dispersion through a 2 liter capacity reservoir using steel balls as the grinding media for 6 hrs.

EXAMPLE 3

An aromatic polyester binder with magnetic particles was cast to a dry thickness of about 1.2 microns onto subbed polyethylene terephthalate or polyethylene naphthalate from a dispersion composition as shown in Table 3. This dispersion was prepared by adding a dispersion of the magnetic particle as shown in Table 1. A dispersion of the abrasive particle in methyl ethyl ketone and a stabilizing agent sold by Zeneca, Inc. (ICI) under the trade designation Solsperse 24000 was then added using a high shear mixer. A coating aid was then added with low shear. Subsequently, the cast magnetic layer was overcoated with 2 mg/ft$^2$ of stearamide.

TABLE 3

| Dispersion Ingredient | Function | Percent |
|---|---|---|
| Polyester | binder | 3.05 |
| Toda CSF-4085V2 | Magnetic Particle | 0.1208 |
| Zeneca Solsperse 24000 | Dispersing Agent | 0.1762 |
| Dibutyl Phthalate | Grind Solvent | 0.4961 |
| Sumitomo AKP-50 (0.25 $\mu$m) | Abrasive Particle | 0.1105 |
| 3M FC-431* | Coating Aid | 0.0142 |
| Dichloromethane | Solvent | 76.68 |
| Methyl Ethyl Ketone | Solvent | 19.17 |

*Minnesota Mining and Manufacturing Company, St Paul, Minnesota
**Sumitomo Chemical Co., Ltd., New York, New York

EXAMPLE 4

An aromatic polyester binder with magnetic particles was cast to a dry thickness of about 1.2 microns onto subbed polyethylene terephthalate or polyethylene naphthalate from a dispersion composition as shown in Table 3. The dispersion was prepared in a small media mill with a decrease in dibutyl phthalate from 12.5 to 6.77 weight percent.

TABLE 4

| Dispersion Ingredient | Function | Percent |
|---|---|---|
| Polyester | binder | 3.05 |
| Toda CSF-4085V2 | Magnetic Particle | 0.12 |
| Zeneca Solsperse 24000 | Dispersing Agent | 0.037 |
| Dibutyl Phthalate | Grind Solvent | 0.242 |
| Sumitomo AKP-50 (0.25 $\mu$m) | Abrasive Particle | 0.110 |
| 3M FC-431 | Coating Aid | 0.014 |
| Dichloromethane | Solvent | 76.79 |
| Methyl Ethyl Ketone | Solvent | 19.20 |

COMPARATIVE EXAMPLE 5

A cellulose diacetate/cellulose triacetate binder with magnetic particles and abrasive particles was cast to a thickness of about 1.2 microns onto subbed polyethylene terephthalate or polyethylene naphthalate from a dispersion composition as shown in Table 5.

TABLE 5

| Dispersion Ingredient | Function | Percent |
|---|---|---|
| Cellulose Diacetate | Binder | 2.565 |
| Cellulose Triacetate | Binder/Dispersion Stabilizer | 0.118 |
| Toda CSF-4085V2 | Magnetic particle | 0.118 |
| Rhodafac PE510 | Surfactant | 0.006 |
| Dibutyl phthalate | Grind solvent | 0.136 |
| 3M FC-431 | Coating Aid | 0.015 |
| Methylene chloride | Solvent | 67.926 |
| Acetone | Solvent | 24.26 |
| Methyl acetoacetate | Solvent | 4.854 |

EVALUATION METHODS

Abrasion/Scratch Resistance

The resistance to abrasion and scratches of lubricated cast layers was evaluated with a Taber Abrader. This test consists of a turntable on which a transparent sample is mounted. Two CS 10F wheels at a load of 124 grams are in contact with the rotating sample. The wheels turn in opposite directions creating an abrasion tract. The abrasion severity is determined optically by measuring the difference in haze (reported as % delta haze) produced by the abraded and unabraded sample using an HL-211 Hazegard System which measures transmitted light on a percentage bases for any light deviating by more than 2.5° from the incident beam. The Taber Abrader is typically insensitive to surface lubrication.

Rotating Drum Friction Test

The running durability of the lubricated cast layers was evaluated using a Steinberg Rotating Drum Friction Tester. The initial (breakaway) friction coefficient and final (running) friction coefficient are measured under 50 gram load and drum speed of 30 cm/sec at 23° C. and 50% relative humidity. The running friction is measured after 10 minutes. The Rotating Drum Friction Test is sensitive to surface lubrication.

Head Clogging Test

Head clogging of the lubricated cast layers was evaluated using a Honeywell 7600 reel-to-reel transport operating at a tape speed of 3.75 inches per second and a tape tension of 13 ounces. Output signal characterization was performed using a Tektronix 7854 digitizing oscilloscope. Head clogging was determined to have occurred if the peak-to-peak output voltage decreased along the length of the tape.

High Pressure Head Film Interface

Head clogging and film durability were evaluated using a Kodak photofinisher head-film interface (HFI) which has head loads of about 70 grams. The test method follows the procedure of an hysteretically recording a squarewave pattern on the photographic element and then driving the element forwards and backwards through the HFI while measuring the average amplitude and pulsewidth. The sample was judged to fail if the signal amplitude decreased by a statistically significant amount in three successive cycles.

Annealability

Sticking (or blocking) of the lubricated cast layer to the bare film support or film support overcoated with Gel sub was evaluated in roll format. Approximately 900 ft. of 11 inch wide film support overcoated with the lubricated cast layer was rolled onto a 6 inch diameter fiberglass roller core and heated in an air convection oven at 230° F., for 3 days followed by 212° F., for 2 days. The sample was judged to fail if excessive visual degradation or stick was observed when the sample was unrolled.

TABLE 6

| Number | Taber Haze | Rotating Drum Initial | Friction Running | Head Clogging |
|---|---|---|---|---|
| Example 3 | 14.6 | 0.22 | 0.10 | no |
| Example 4 | | | | no |
| Comparative Example 5 | 16.1 | 0.23 | 0.07 | yes |

TABLE I

| | Visual degradation | Gel Sub Stick | Film Base Stick |
|---|---|---|---|
| Example 3 | no | no | no |
| Example 4 | no | no | no |
| Comparative Example 5 | yes/no | yes/no | yes |

As is apparent from the results in Table 7, Examples 3 and 4 offer excellent resistance to degradation, gel sub stick, and film base stick.

EXAMPLES 6 AND 7

A color photographic recording material for color negative development was prepared by applying the following layers in the given sequence to the opposite side of each of the supports of Examples 3 and 4 respectively. The quantities of silver halide are given in grams (g) of silver per $m^2$. The quantities of the other materials are given in g per m.

Layer 1 {Antihalation Layer} black colloidal silver sol containing 0.236 g of silver, with 2.44 g gelatin.

Layer 2 {First (least) Red-Sensitive Layer} Red sensitized silver iodobromide emulsion [1.3 mol % iodide, average grain diameter 0.55 microns, average thickness 0.08 microns] at 0.49 g, red sensitized silver iodobromide emulsion [4 mol % iodide, average grain diameter 1.0 microns, average thickness 0.09 microns] at 0.48 g, cyan dye-forming image coupler C-1 at 0.56 g, cyan dye-forming masking coupler CM-1 at 0.033 g, BAR compound B-1 at 0.039 g, with gelatin at 1.83 g.

Layer 3 {Second (more) Red-Sensitive Layer} Red sensitive silver iodobromide emulsion [4 mol % iodide, average grain diameter 1.3 microns, average grain thickness 0.12 microns] at 0.72 g, cyan dye-forming image coupler C-1 at 0.23 g, cyan dye-forming masking coupler CM-1 at 0.022 g, DIR compound D-1 at 0.011 g, with gelatin at 1.66 g.

Layer 4 {Third (most) Red-Sensitive Layer} Red sensitized silver iodobromide emulsion [4 mol % iodide, average grain diameter 2.6 microns, average grain thickness 0.13 microns] at 1.11 g, cyan dye-forming image coupler C-1 at 0.13 g, cyan dye-forming masking coupler CM-1 at 0.033 g, DIR compound D-1 at 0.024 g, DIR compound D-2 at 0.050 g, with gelatin at 1.36 g.

Layer 5 {Interlayer} Yellow dye material YD-1 at 0.11 g and 1.33 g of gelatin

Layer 6 {First (least) Green-Sensitive Layer} Green sensitized silver iodobromide emulsion [1.3 mol % iodide, average grain diameter 0.55 microns, average grain thickness 0.08 microns] at 0.62 g, green sensitized silver iodobromide emulsion [4 mol % iodide, average grain diameter 1.0 microns, average grain thickness 0.09 microns] at 0.32 g, magenta dye-forming image coupler M-1 at 0.24 g, magenta dye-forming masking coupler MM-1 at 0.067 g with gelatin at 1.78 g.

Layer 7 {Second (more) Green-Sensitive Layer} Green sensitized silver iodobromide emulsion [4 mol % iodide, average grain diameter 1.25 microns, average grain thickness 0.12 microns] at 1.00 g, magenta dye-forming image coupler M-1 at 0.091 g, magenta dye-forming masking coupler MM-1 at 0.067 g, DIR compound D-1 at 0.024 g with gelatin at 1.48 g.

Layer 8 {Third (most) Green-Sensitive Layer} Green sensitized silver iodobromide emulsion [4 mol % iodide, average grain diameter 2.16 microns, average grain thickness 0.12 microns] at 1.00 g, magenta dye-forming image coupler M-1 at 0.072 g, magenta dye-forming masking coupler MM-1 at 0.056 g, DIR compound D-3 at 0.01 g, DIR compound D-4 at 0.011 g, with gelatin at 1.33 g.

Layer 9 {Interlayer} Yellow dye material YD-2 at 0.11 g with 1.33 g gelatin.

Layer 10 {First (less) Blue-Sensitive Layer} Blue sensitized silver iodobromide emulsion [1.3 mol % iodide, average grain diameter 0.55, average grain thickness 0.08 microns] at 0.24 g, blue sensitized silver iodobromide emulsion [6 mol % iodide, average grain diameter 1.0 microns, average grain thickness 0.26 microns] at 0.61 g, yellow dye-forming image coupler Y-1 at 0.29 g, yellow dye forming image coupler Y-2 at 0.72 g, cyan dye-forming image coupler C-1 at 0.017 g, DIR compound D-5 at 0.067 g, BAR compound B-1 at 0.003 g with gelatin at 2.6 g.

Layer 11 {Second (more) Blue-Sensitive Layer} Blue sensitized silver iodobromide emulsion [4 mol % iodide, average grain diameter 3.0 microns, average grain thickness 0.14 microns] at 0.23 g, blue sensitized silver iodobromide emulsion [9 mol % iodide, average grain diameter 1.0 microns] at 0.59 g, yellow dye-forming image coupler Y-1 at 0.090 g, yellow dye-forming image coupler Y-2 at 0.23 g, cyan dye-forming image coupler C-1 0.022 g, DIR compound D-5 at 0.05 g, BAR compound B-1 at 0.006 g with gelatin at 1.97 g.

Layer 12 {Protective Layer} 0.111 g of dye UV-1, 0.111 g of dye UV-2, unsenitized silver bromide Lippman emulsion at 0.222 g, 2.03 g.

This film is hardened at coating with 2% by weight to total gelatin of hardener H-1. Surfactants, coating aids, scavengers, soluble absorber dyes and stabilizers are added to the various layers of this sample as is commonly practiced in the art.

The formulas for the component materials are as follows:

C-1:

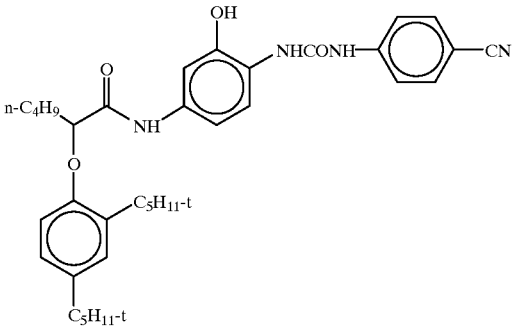

CM-1

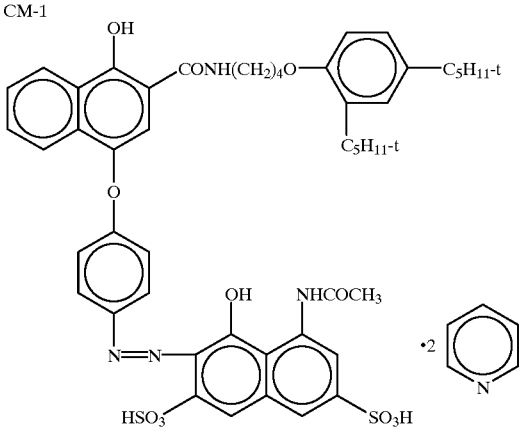

B-1

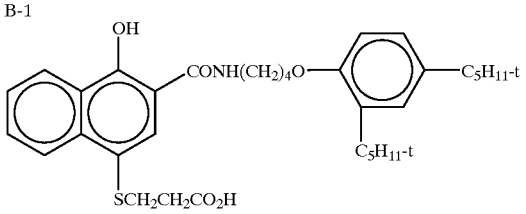

-continued

D-1:

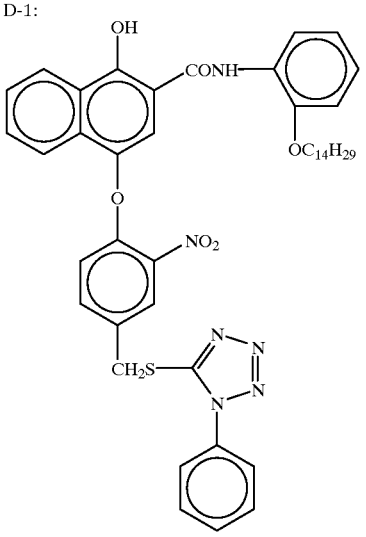

D-2

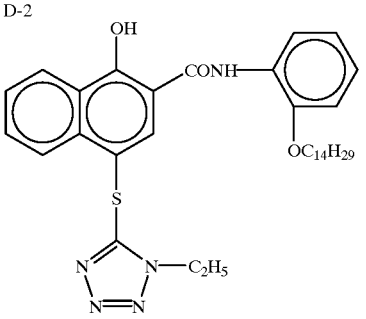

D-3:

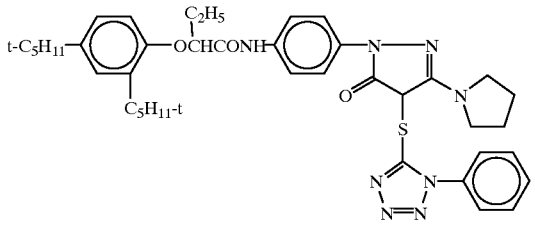

D-4

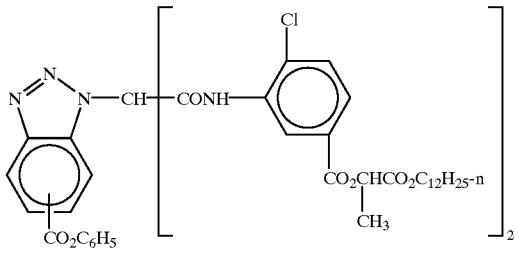

-continued
D-5:
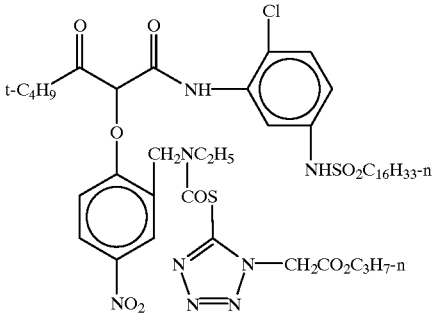
MM-1
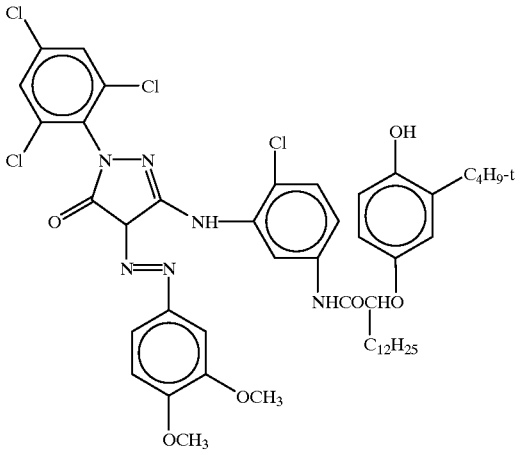
Y-1:
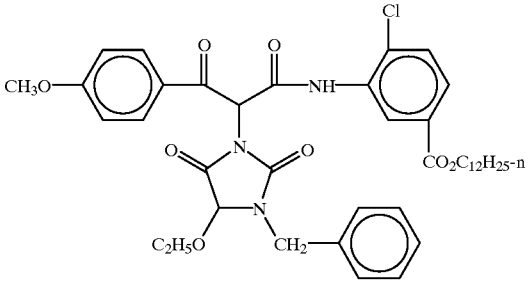
Y-2:
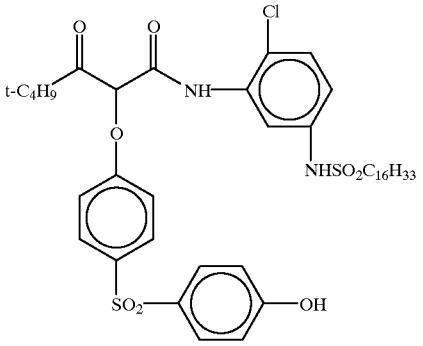
-continued
M-1:
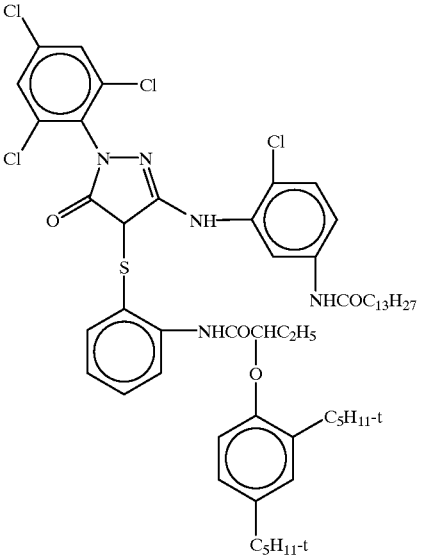
YD-1:
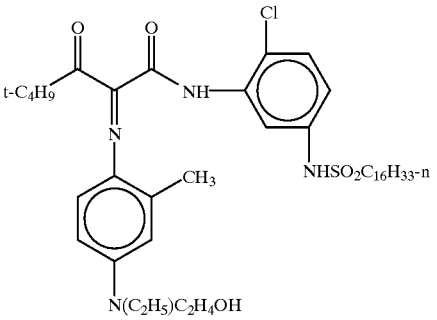
YD-2:
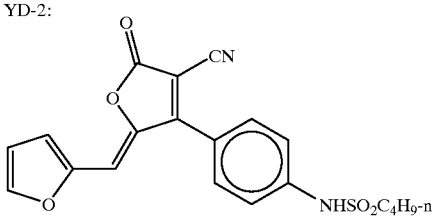
UV-1:
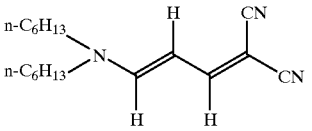
UV-2:
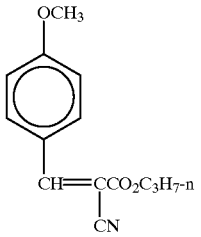
H-1:
$CH_2(SO_2CH{=}CH_2)_2$ The invention has been described in detail with particular reference to certain preferred embodiments thereof, but it will be understood that variations and modifications can be effected within the spirit and scope of the invention.

What is claimed is:

1. A silver halide photographic element comprising a support having a frontside and a backside;

a light-sensitive silver halide emulsion layer superposed on the frontside of the support; and a transparent magnetic recording layer superposed on the backside of the support, said magnetic recording layer comprising magnetized particles, a dispersing agent and an aromatic polyester binder having a Tg of greater than 150° C.

2. The silver halide photographic element of claim 1 wherein the polyester binder is the reaction product of one or more dibasic aromatic acids and one or more dihydroxy phenols.

3. The silver halide photographic element of claim 2 wherein the aromatic dibasic acids are represented by the following structure:

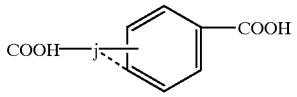

wherein j is an optional linking group positioned meta or para to the carboxyl group of the phenyl ring or j represents the atoms necessary to form a 5 or 6-membered fused carboxylic or heterocyclic ring between any two adjacent carbon atoms of the phenyl ring.

4. The silver halide photographic element of claim 3 wherein j is selected from

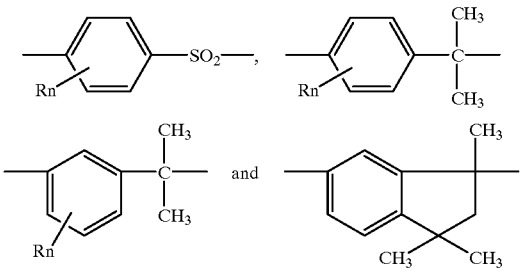

selected or j is a 5 or 6 membered ring which forms the the following dibasic acid structures:

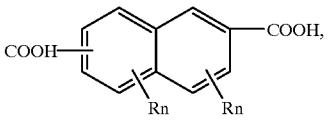

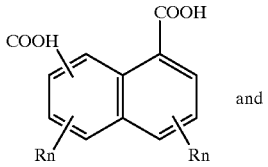

-continued

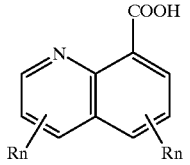

wherein R is individually a halide or hydrogen atom, a substituted or unsubstituted alkyl or alkoxy group of from 1 to about 6 carbon atoms, or a substituted or unsubstituted aryl group of from about 6 to about 10 carbon atoms; and n is an integer from 1 to 4.

5. The silver halide photographic element of claim 2 wherein the aromatic dibasic acid is terephthalic acid, isophthalic acid, 2,5-dimethylterephthalic acid, 2,5-dibromoterephthalic acid, bis(4-carboxyphenel)sulfone, 1,1,3-trimethyl-3-(4-carboxyphenyl)-5-indanecarboxylic acid, 2,6-naphthalenedicarboxylic acid, or 2,2-bis(4-carboxyphenyl)propane.

6. The silver halide photographic element of claim 2 wherein the dihydroxyphenol is represented by the following structure:

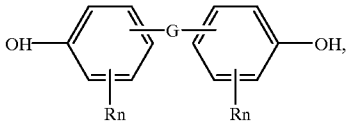

wherein G is a linking group positioned meta or para to each phenolic hydroxyl and is selected from the following:

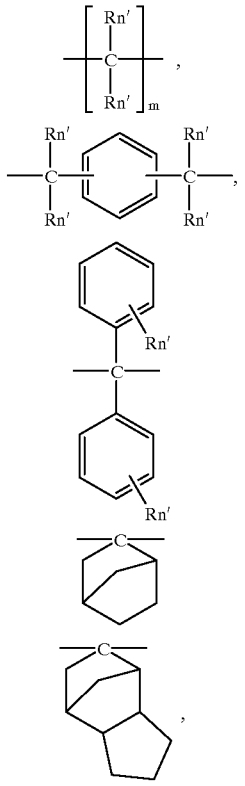

-continued

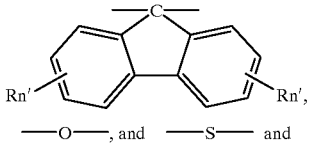

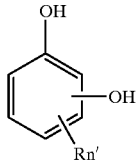

wherein the hydroxyl groups are positioned meta or para to each other; wherein R is individually a halide or hydrogen atom, a substituted or unsubstituted alkyl or alkoxy group of from 1 to about 6 carbon atoms, or a substituted or unsubstituted aryl group of from about 6 to about 10 carbon atoms; and n is an integer from 1 to 4.

7. The silver halide photographic element of claim 3 wherein the dihydroxyphenol is represented by the following structure:

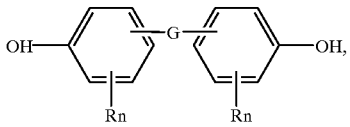

wherein G is a linking group positioned meta or para to each phenolic hydroxyl and can be selected from the following:

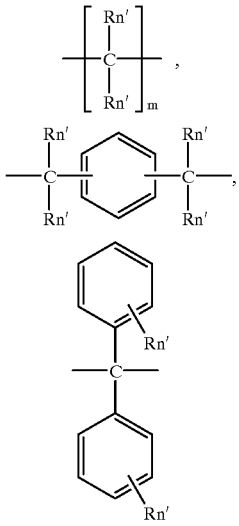

-continued

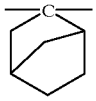

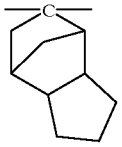

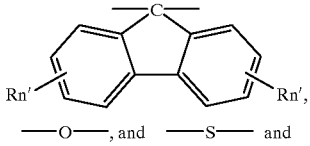

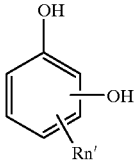

wherein the hydroxyl groups are positioned meta or para to each other, wherein R is individually a halide or hydrogen atom, a substituted or unsubstituted alkyl or alkoxy group of from 1 to about 6 carbon atoms, or a substituted or unsubstituted aryl group of from about 6 to about 10 carbon atoms; is an integer from 1 to 4 and m is an integer from 1 to 6.

8. The silver halide photographic element of claim 2 wherein the dihydroxyphenol is 4,4' (hexafluroisopropylidene) diphenol (bisphenol AF); 4,4'-isopropylidenediphenol (bisphenol A); 4,4'-isopropylidene-2,2',6,6'-tetrachlorobisphenol; 4,4'-isopropylidene-2,2'6,6'-tetrabromobisphenol; 4,4'-(hexahydro-4,7-methanoinden-5-ylidene) bisphenol; 4,4'-(2-norbomylidine) bisphenol; 9,9-bis-(4-hydroxyphenol) fluorene, bis(4-hydroxyphenyl) diphenol methane; 1,4-bis(p-hydroxycumyl)benzene; 1,3bis (p-hydroxycumyl)benzene; 4,4'-oxybisphenol, hydroxyquinone or resorcinol.

9. The silver halide photographic element of claim 5 wherein the dihydroxyphenol is 4,4' (hexafluroisopropylidene) diphenol (bisphenol AF); 4,4'-isopropylidenediphenol (bisphenol A); 4,4'-isopropylidene-2,2',6,6'-tetrachlorobisphenol; 4,4'-isopropylidene-2,2'6,6'-tetrabromobisphenol; 4,4'-(hexahydro-4,7-methanoinden-5-ylidene) bisphenol; 4,4'-(2-norbomylidine) bisphenol; 9,9-bis-(4-hydroxyphenol) fluorene, bis(4-hydroxyphenyl) diphenol methane; 1,4-bis(p-hydroxycumyl)benzene; 1,3bis (p-hydroxycumyl)benzene; 4,4'-oxybisphenol, hydroxyquinone or and resorcinol.

10. The silver halide photographic element of claim 2 wherein the polyester binder is represented by the following structures:

Polyester 1

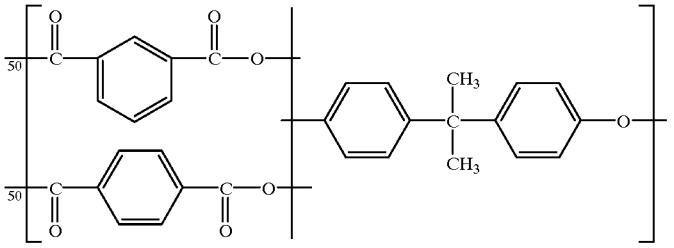
Tg = 170
Polyester 2
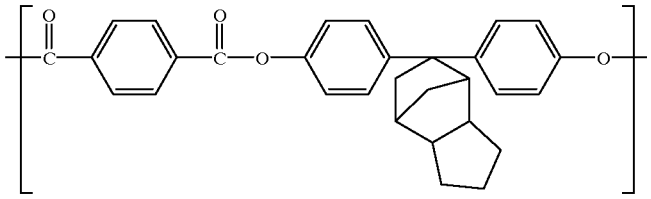
Tg = 299
Polyester 3
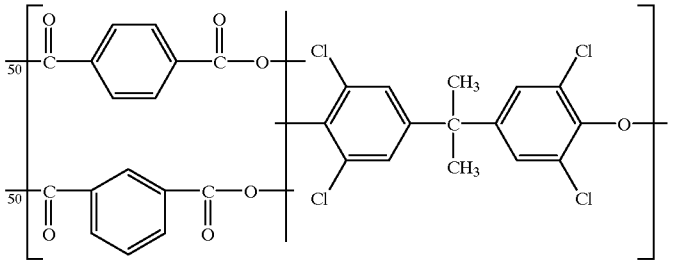
Tg = 231
Polyester 4
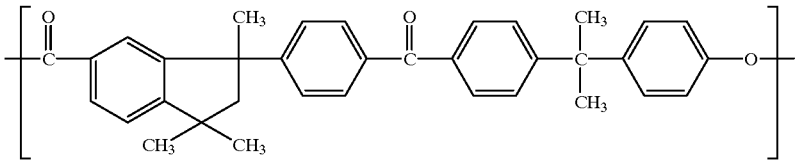
Tg = 247
or
60

Polyester 5

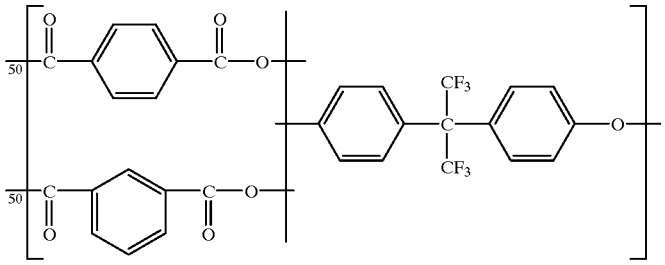

Tg = 223

11. The silver halide element of claim 1 wherein the magnetic layer further comprises abrasive particles.

12. The silver halide element of claim 11 wherein the abrasive particles are alpha-alumina, chromium oxide ($Cr_2O_3$), alpha-$Fe_2O_3$, silicon dioxide, alumino-silicate, titanium carbide; silicon nitride, titanium nitride or diamond in fine powder.

13. The silver halide element of claim 9 wherein the magnetic layer further comprises abrasive particles.

14. The silver halide element of claim 13 wherein the abrasive particles are selected from alpha-alumina, chromium oxide ($Cr_2O_3$), alpha-$Fe_2O_3$, silicon dioxide, alumino-silicate, titanium carbide; silicon nitride, titanium nitride and diamond fine powder.

15. The silver halide element of claim 1 wherein the magnetic particles are ferromagnetic iron oxides, other metals in solid solution or surface treated form, barium or strontium ferrites; or ferromagnetic chromium dioxide.

16. The silver halide element of claim 15 wherein the magnetic particles are cobalt surface treated iron oxide.

17. The silver halide element of claim 9 wherein the magnetic particles are cobalt surface treated iron oxide.

* * * * *